US006779786B2

(12) United States Patent
Ruscheweyh et al.

(10) Patent No.: US 6,779,786 B2
(45) **Date of Patent: *Aug. 24, 2004**

(54) MIXER FOR MIXING AT LEAST TWO FLOWS OF GAS OR OTHER NEWTONIAN LIQUIDS

(75) Inventors: Hans Ruscheweyh, Aachen (DE); Michael Kaatz, Ratingen (DE); Miroslav Podhorsky, Ratingen (DE)

(73) Assignee: Balcke-Durr GmbH, Oberhausen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/884,356

(22) Filed: Jun. 19, 2001

(65) Prior Publication Data

US 2002/0017731 A1 Feb. 14, 2002

(30) Foreign Application Priority Data

Jun. 19, 2000 (EP) ..... 00112875

(51) Int. Cl.[7] ..... B01F 3/04
(52) U.S. Cl. ..... 261/79.2; 366/181.5
(58) Field of Search ..... 261/79.02; 366/181.5, 366/337

(56) References Cited

U.S. PATENT DOCUMENTS

| | | | | | |
|---|---|---|---|---|---|
| 3,332,401 | A | * | 7/1967 | Lustenader | 261/79.2 |
| 3,557,830 | A | * | 1/1971 | Raw | 366/337 |
| 3,885,918 | A | * | 5/1975 | Isahaya | 261/79.2 |
| 4,270,576 | A | * | 6/1981 | Takeda et al. | 366/337 |
| 4,498,786 | A | * | 2/1985 | Ruscheweyh | 366/337 |
| 4,527,903 | A | | 7/1985 | Ruscheweyh | |
| 4,812,049 | A | * | 3/1989 | McCall | 366/181.5 |
| 4,899,772 | A | * | 2/1990 | Rao | 366/337 |
| 4,929,088 | A | * | 5/1990 | Smith | 366/337 |
| 5,456,533 | A | * | 10/1995 | Streiff et al. | 366/337 |
| 5,547,540 | A | | 8/1996 | Ruscheweyh | |
| 6,135,629 | A | * | 10/2000 | Dohmann | 366/181.5 |
| 2001/0038575 | A1 | * | 11/2001 | Mathys et al. | 366/181.5 |
| 2002/0031046 | A1 | * | 3/2002 | Schneider et al. | 366/181.5 |

FOREIGN PATENT DOCUMENTS

| | | | | |
|---|---|---|---|---|
| DE | 37 23 618 | | 12/1988 | |
| DE | 82 19 268.5 | | 10/1992 | |
| EP | 29 11 873 | | 11/1980 | |
| EP | 0 526 393 | | 2/1993 | |
| EP | 0 956 897 | | 11/1999 | |
| JP | 61-138520 | * | 6/1986 | 366/181.5 |
| RU | 415031 | * | 2/1974 | 261/79.2 |
| RU | 1599067 A1 | * | 10/1990 | 261/79.2 |
| WO | WO 90/00929 | | 2/1990 | |

* cited by examiner

*Primary Examiner*—Scott Bushey
(74) *Attorney, Agent, or Firm*—Baker & Hostetler LLP

(57) ABSTRACT

A mixer for mixing at least two flows of gas or other Newtonian liquids is provided herein. The mixer includes a main flow channel through which a first flow of gas passes, with an incorporated surface that is arranged therein and which affects the flow. This incorporated surface has leading edges that are orientated against the flow and about which the flow can move freely; the leading edges include a component that acts in the direction of the main flow of the gas flow as well as a component that acts transversely thereto. In order to ensure that an additional gas or liquid component is mixed in rapidly, provision is made such that the incorporated structure surface has a chamber into which a separate flow channel for a second gas flow leads and the chamber has outlet openings into the first gas flow on a rear side of the incorporated surface that faces away from the first gas flow.

10 Claims, 4 Drawing Sheets

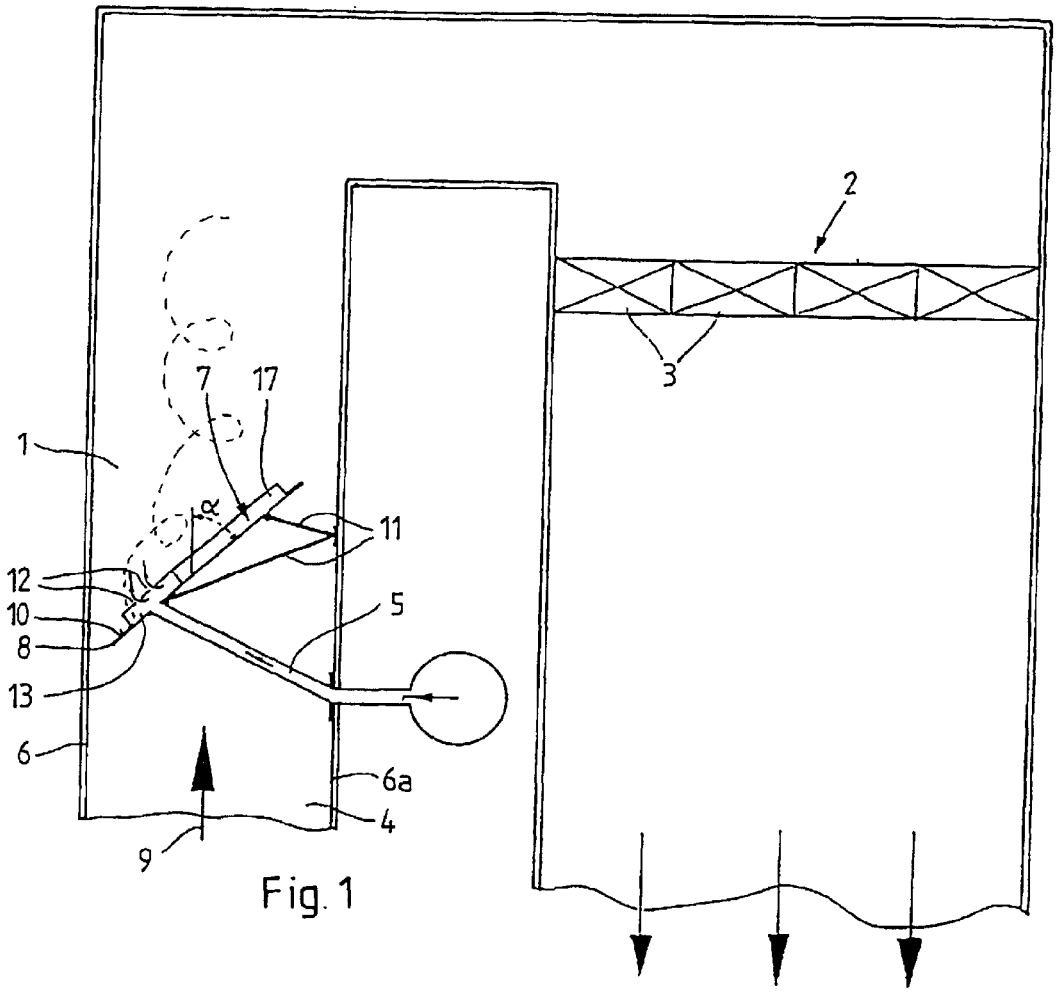
Fig. 1
Fig. 2
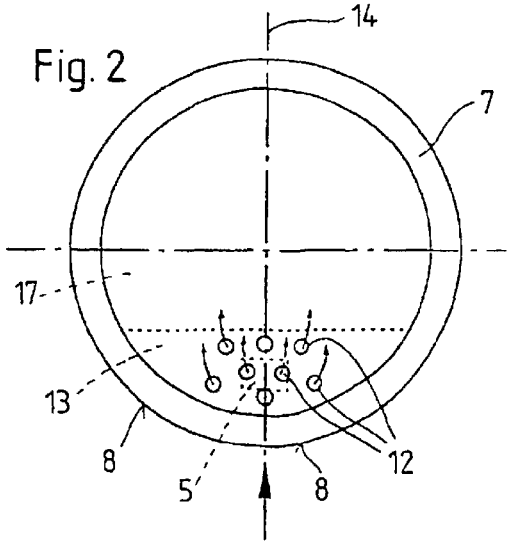
Fig. 3
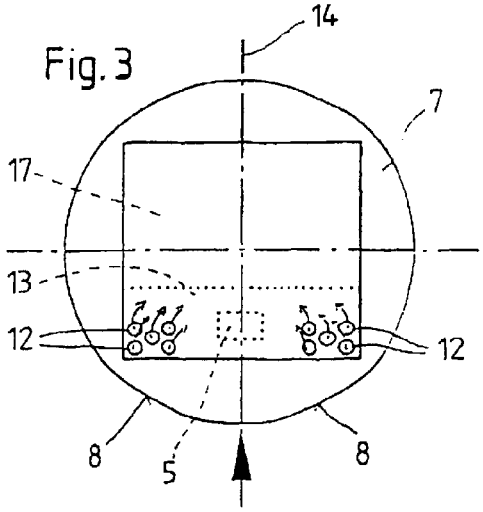

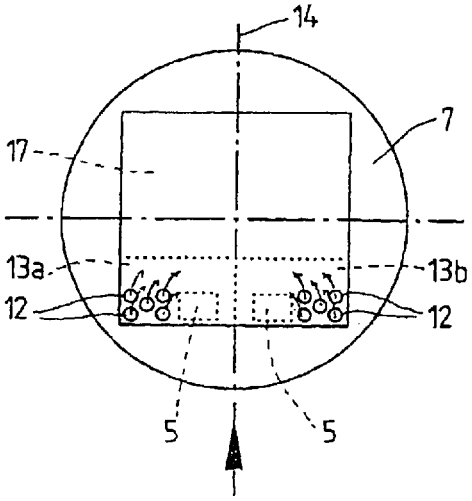
Fig. 4
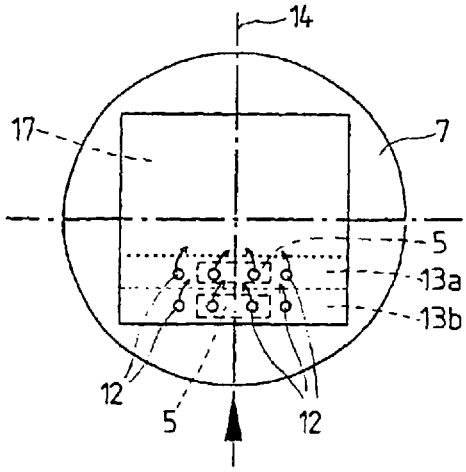
Fig. 5
Fig. 6
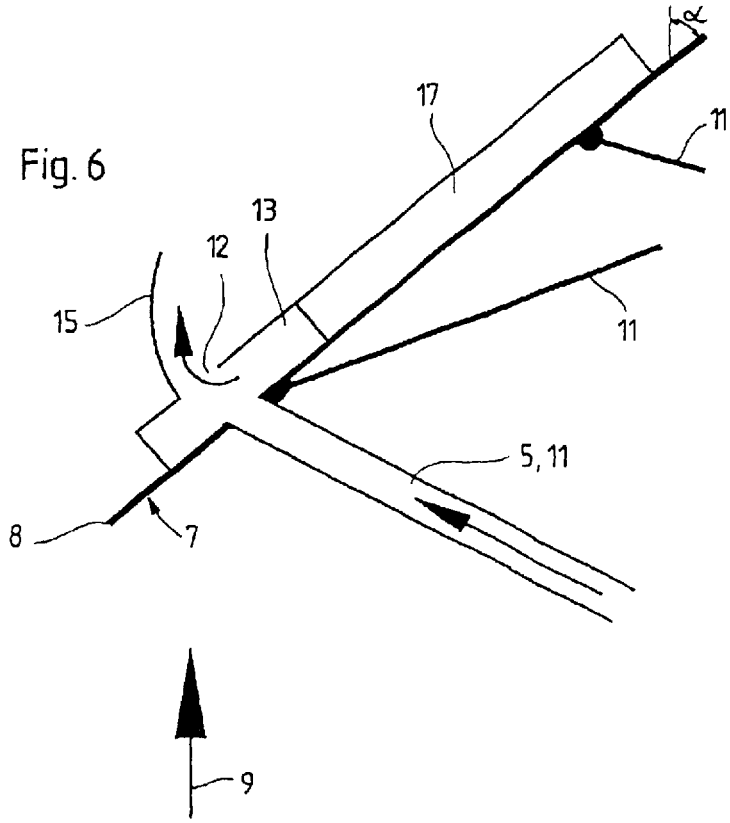

MIXER FOR MIXING AT LEAST TWO FLOWS OF GAS OR OTHER NEWTONIAN LIQUIDS

TECHNICAL FIELD

The present invention relates to a mixer for mixing at least two flows of gas or other Newtonian liquids, with a main flow channel through which the first flow of gas passes, and incorporated surfaces that are arranged therein, these incorporated surfaces affecting the flow, the incorporated surface being a vortex-generating disk that has a leading edge that is oriented against the flow and about which the flow can move freely, the shape of this leading edge having a component that acts in the main direction of flow of the gas, and a component that acts transversely to this.

BACKGROUND OF THE INVENTION

In order to mix flows of gas or liquids in pipe lines or channels, given a turbulent flow, one requires mixing lengths of 15 to 100-times the diameter of the channel. The length of this mixing section can be reduced significantly by using suitable static mixers in the form of incorporated bodies. However, in most of the systems that are usually used, a major loss of pressure has to be accepted if great demands are to be imposed with respect to homogeneity of the mixture that is produced. Many conventional mixing systems are also restricted to simple geometry, e.g., cylindrical pipes or rectangular channels, and cannot be used over great lengths and in complex mixing-chamber systems.

U.S. Pat. No. 4,527,903 describes a static mixer for use in a cooling tower; in this, the incorporated structures are delta-shaped or circular sheet-metal disks that the flow strikes at an angle; vortices are formed at their leading edges. The stationery and stable vortex systems that are so formed act in the wake of the flow; the components that are to be mixed are rolled up in the form of layers, which results in very rapid mixing with very small pressure losses. These so-called incorporated vortex structures have proved themselves in practice because of the short mixing sections that they make possible.

SUMMARY OF THE INVENTION

It is the objective of the present invention to describe a mixer for mixing at least two flows of gas or other Newtonian liquids, which is characterized by rapid mixing in short mixing sections, even if a comparatively small proportion of an additional component is to be mixed in with a volume flow.

This objective has been achieved with a mixer having the features described in the introduction hereto, that is characterized in that the incorporated surface has a chamber into which a separate flow channel for a second flow of gas leads; and in that on the rear side of the incorporated surface that faces away from the inflow of the first gas flow the chamber has outlet openings into the first flow of gas.

The advantages of such a mixer are seen, in particular, in those cases when a relatively small volume flow of the second component is to be mixed into a large volume flow of a first component and, at the same time, homogenization is to be achieved in a short mixing section. The chamber into which the flow channel for the second flow of gas leads makes it possible to distribute the outlet openings for the second flow of gas according to the manner in which the mixer is operated, i.e., these outlet openings can be arranged with a great degree of design freedom. Thus, for example, it is possible to orient the outlet openings against the main flow of gas, or else incorporate baffles that direct the flow of gas that emerges from the outlet openings into the area of the vortexes that are being formed by the leading edges of the disc.

Application possibilities can be seen, for example, in denox plants for scrubbing smoke gases or when processing the dust collected by electro-filters. When scrubbing smoke gas, $NH_3$ or $NH_4OH$ is to be mixed into the smoke gas that flows into the reaction chambers, the proportion of ammonia compounds amounting to only about 2%-mass. In this case, using a mixer according to the present invention permits rapid mixing of the two components in a short mixing section. The result of this thorough mixing it is that the profile of the gas and/or liquid flow that it is passed through is evened out, so that performance losses are avoided. Despite the fact that they form extended and stable vortices, the incorporated vortex surfaces cause relatively little resistance to the flow since not all of their surface acts as a baffle; rather, their leading edges generate vortex fields that widen out automatically in the direction of flow, without any additional incorporated structures or baffles being needed to achieve this widening.

A further contribution to achieving homogenization in the shortest possible mixing section is made if, according to a preferred configuration of the present invention, the outlet where the second flow of gas enters the first flow of gas is located in the area of the front half of the disc. In this way, the second flow of gas that is introduced by way of the separate flow channel is picked up by the vortex fields that are generated in the front edge area of the disc.

An additional advantage is that the chamber can be used to reinforce the incorporated surfaces. To this end, it is proposed that the chamber be provided with side walls that are an angle to the disc and stiffen the disc against bending loads and possible oscillations.

With respect to the arrangement of the flow channel for the second flow of gas within the main flow channel, it is proposed that the separate flow channel be led to this on the front side of the disc. In this way, the installed volume of the separate flow channel has no effect on the formation of vortices and their propagation on the rear side of the disc.

Finally, in order to achieve structural unification and thus simplification, it is proposed that the disc be supported in the main flow channel by struts, of which one is in the form of a tube and forms the separate flow channel. In this case, the flow channel assumes an additional static function in the arrangement of the incorporated vortex surfaces within the main flow channel.

One embodiment of the present invention is shown in the drawings appended hereto. These drawings show the following:

BRIEF DESCRIPTION OF THE DRAWINGS

FIG. 1: a cross section through a denox plant of a smoke-gas scrubber with an incorporated vortex surfaces in the form of a disc that is arranged in the main flow channel ahead of the reactor;

FIG. 2: a plan view of the rear side of the disc shown in FIG. 1;

FIG. 3: a plan view of the rear side of a disc in a version that has been modified with respect to FIG. 2;

FIG. 4: a plan view of the rear side of a disc in a version that has been further modified with respect to FIG. 2 and FIG. 3;

FIG. 5: a plan view of another embodiment;

FIG. 6: a cross section of another embodiment of an incorporated vortex surface that is in the form of a disc;

DETAILED DESCRIPTION OF THE PREFERRED EMBODIMENT

Figure 7:
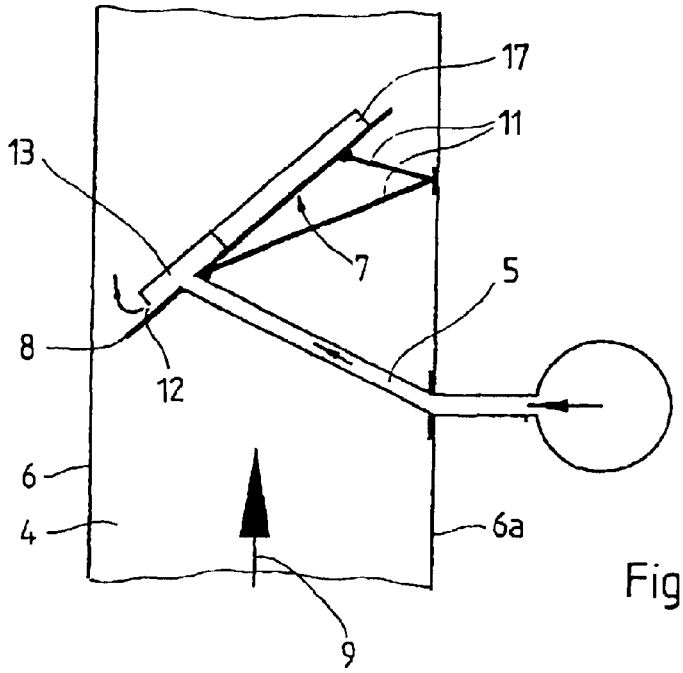
FIG. 7: a cross section that includes the main flow channel of another embodiment of an incorporated vortex surface in the form of a disc.

FIG. 1 is a cross section through part of a smoke-gas nitrogen-removal plant with a main flow channel 1 in a rising arm of the plant and a reactor 2 in a downward flow arm of said plant. The reactor 2 is usually fitted with catalysts 3. When the plant is operated, $NH_3$ or $NH_4OH$ is mixed into the smoke gas that enters the main flow channel at reference point 4. This is done by way of a separate flow channel 5 that passes through the wall 6 of the main flow channel 1. Next, in a manner that is described in greater detail below, there is rapid distribution and thus homogenization of the ammonia compound in the smoke gas, so that when it subsequently flows into the reactor 2, the ammonia compound is distributed evenly throughout the flow of smoke gas.

The media are mixed by at least one incorporated surface 7 that is arranged in the main flow channel 1. This incorporated surface 7 is a so-called incorporated vortex surface that is used to generate leading-edge vortices. The leading edge 8 of the incorporated surface 7 that is configured, for example, as a circular disc, which is oriented against the flow in the main flow channel 1 and about which the flow can move freely, has components that act both in the direction of the main flow 9 and transversely to this. Since, in addition, each incorporated surface 7 is arranged at an acute angle $\alpha$ to the main direction of flow 9 in the flow channel 1, vortex fields are formed on each leading edge of the incorporated surface, and these widen out conically as they move downstream. When this happens, the individual vortices roll inward on the rear side 10 of the incorporated surface 7. The vortices that are formed on each individual leading edge 8 are largely stationery and thus do not change position. Because of its rotation, each vortex field forms a component of the flow that is transverse to the main direction 9 in which the gas is flowing, and this results in good mixing of the gas mixture because of the associated pulse exchange across the direction of flow.

The vortex-generating properties of the incorporated surface 7, referred to above, are achieved in conjunction with all of the so-called Newtonian liquids, i.e., with gases and with such fluids that behave in much the same manner as gases with respect to their flow properties.

The separate flow channel 5 for the second flow of gas, which is preferably configured as a tube, extends right into the main flow channel 1, where it opens out in the area of the rear side 10 of the incorporated structures 7 that faces away from the in-flowing first gas flow. The incorporated surface 7 is so supported relative to the wall 6*a* of the main flow channel 1 by a plurality of struts 11 that the angle $\alpha$ subtended with the main flow direction 9 is preferably between 40° and 80°, and is preferably approximately 60°.

FIG. 1 also shows that the outlet opening 12 of the second gas flow is located at the level of the front half of the disc or incorporated surface 7.

The plurality of outlet openings 12 are located in the region of the front half of the incorporated surface 7. The separate flow channel 5 leads to this on the front side of the incorporated surface 7. The tube of the separate flow channel 5 simultaneously assumes the static function of one of the struts 11. These struts 11 are located on the front side of the incorporated structure 7 so that they do not affect the generation of the vortices on its rear side.

In order to ensure adaptation to particular operating conditions, it is possible to change the installation angle $\alpha$ of the disc 7 relative to the main direction of flow 9, for example, by changing the effective length of the struts 11. This modification or adjustment can also be carried out when the mixer is being operated.

FIG. 1 also shows that the separate flow channel 5 does not make an immediate transition into the outlet openings 12; rather, the second flow of gas that is routed through the flow channel 5 first enters a chamber 13 that is arranged on the back of the incorporated surface 7. Outlet openings 12 are then located in the outer side of the chamber 13.

FIG. 2 and FIG. 3 show two possible configurations of the chambers 13; in the FIG. 2, the outlet openings 12 are arranged around the center line 14 of the disc 7, whereas in FIG. 3, the outlet openings are split into two groups on both sides of the center line 14, so as to flow out into each area that is covered by the left-hand or by the right-hand leading edge vortices.

The embodiment that is shown in FIG. 4 differs from the embodiment shown in FIG. 3 in that it shows two separate flow channels 5 through which two separate flows of gas move into two separate chambers 13*a*, 13*b*. In this way, it is possible to mix two different flows of gas into the flow of gas that is passing through the main flow channel. The separate chambers 13*a*, 13*be* can be located one behind the other. This is shown in FIG. 5.

FIG. 6 shows that the outlet opening 12 of the chamber can be provided with a deflector 15 so as to achieve the most favourable possible inflow of the second flow of gas into the area of the front leading edge vortices that are formed.

Figure 8:
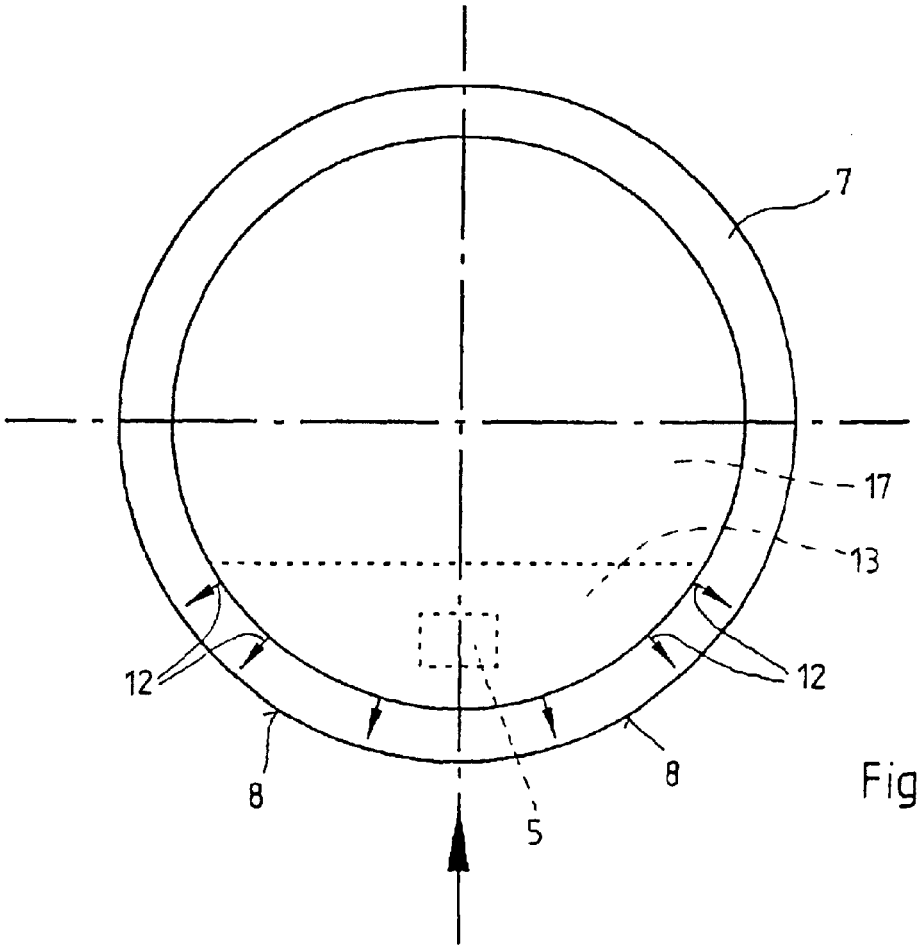
FIG. 8: a plan view of the rear side of the disc shown in FIG. 7.

FIG. 7 and FIG. 8 show that the outlet openings 12 can also be located in the region of the front face side 16 of the chamber 13. This results in an outflow that is oriented so as to be almost opposite the vortex field that is formed on the leading edges 8, so that mixing takes place very early.

Figure 9:
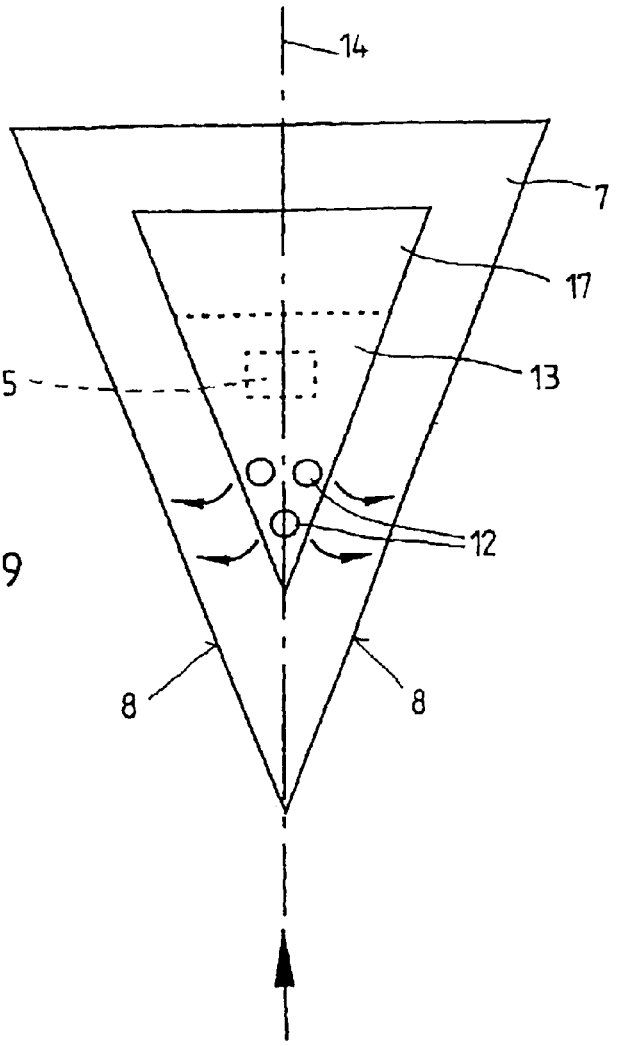
FIG. 9: a plan view of the back of an incorporated vortex surface in the form of a delta-shaped disc.
Figure 10:
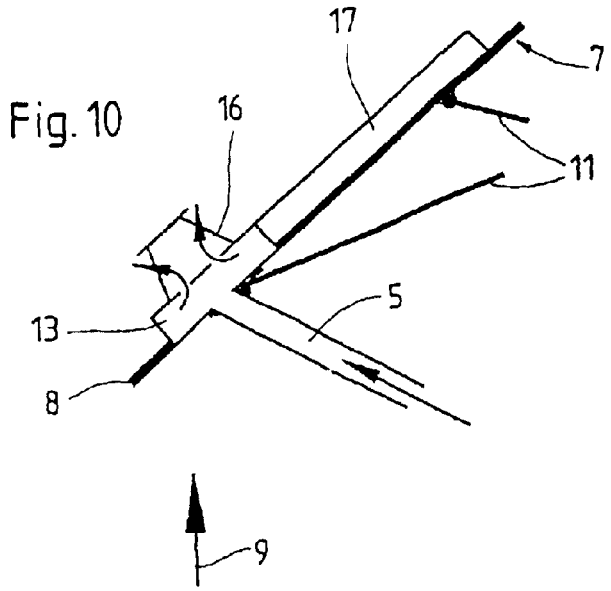
FIG. 10: a cross section through another embodiment of a disc-shaped incorporated vortex surface.

Within the context of the embodiments of the present invention described heretofore, the incorporated surfaces 7 are essentially circular or elliptical. FIG. 9 and FIG. 10 show that the incorporated surfaces can also be delta-shaped triangles with their apices oriented against the direction of flow. In addition, as can be seen in FIG. 10, an additional cowl 16 can be provided for the outlet of the second gas flow, this having outlet openings 12 distributed about its total circumference. The cowl 16 is set on the rear side of the chamber 13 that is arranged on the rear of the disc 7, although the chamber 13 can itself be in the shape of a cowl.

As depicted in FIGS. 1–10, the various embodiments of the chamber 13 include a cross-section that is preferably bigger and/or larger than the separate flow channel 5.

Finally, the FIGS. 1 to 10 show that since they are perpendicular to the incorporated surface 7 or at least as an angle to this, the walls of the chamber 13 can reinforce the incorporated surfaces 7 with respect to bending loads. For this reason, the chambers 13 that serve as distributors for the second flow of gas can include additional chambers 17, which perform no distribution function or flow functions, but are used exclusively to stiffen the incorporated surfaces 7.

What is claimed is:

1. Mixer for mixing at least two flows of gas or other Newtonian liquids, comprising:

a main flow channel comprising a wall through which a first flow of gas passes; and an incorporated surface arranged in the main flow channel which affects the first flow, the incorporated surface having leading edges that are oriented against the first flow and around which the first flow can move freely, the leading edge having components that act in a main direction of flow of the gas as well as transversely thereto;

a plurality of struts that support the incorporated surface relative to the wall; and a device to adjust an angle of the incorporated surface relative to the main direction of flow, wherein the incorporated surface has a chamber which is connected with a separate flow channel for a second flow of gas for routine the second flow of gas through the main flow channel into the chamber, the chamber having a bigger cross-section than the separate flow channel, and wherein said chamber being provided with outlet openings of the second flow of gas into the first flow of gas, and wherein the outlet openings are provided on a rear side of the incorporated structure, that faces away from an inflow of the first flow of gas.

2. Mixer as defined in claim 1, wherein an opening of the second flow of gas into the first flow of gas is located at a front half of the incorporated surface.

3. Mixer as defined in claim 1, wherein the chamber includes side walls arranged at an angle to the incorporated surface which stiffen said incorporated surface against bending loads.

4. Mixer as defined in claim 1 wherein the separate flow channel is routed to the incorporated surface on a front side thereof.

5. Mixer as defined in claim 1, wherein the incorporated surface is a vortex-generating disc.

6. Mixer as defined in claim 1 wherein one of the struts is tubular and forms the separate flow channel.

7. Mixer for mixing at least two flows of gas or other Newtonian liquids, comprising:

a main flow channel comprising a wall through which a first flow of gas passes; and an incorporated surface arranged in the main flow channel which affects the first flow, the incorporated surface having leading edges that are oriented against the first flow and around which the first flow can move freely, the leading edge having components that act in a main direction of flow of the gas as well as transversely thereto;

a plurality of struts that support the incorporated surface relative to the wall, wherein the incorporated surface has one or more chambers which are connected with a separate flow channel for a second flow of gas for routine the second flow of gas through the main flow channel into the one or more chambers, the one or more chambers having a bigger cross-section than the separate flow channel, and wherein said one or more chambers being provided with outlet openings of the second flow of gas into the first flow of gas, and wherein the outlet openings are provided on a rear side of the incorporated structure, that faces away from an inflow of the first flow of gas, and wherein the outlet openings from separate chambers are arranged one behind the other.

8. Mixer as defined in claim 7, wherein an opening of the second flow of gas into the first flow of gas is located at a front half of the incorporated surface.

9. Mixer as defined in claim 7, wherein the chamber includes side walls arranged at an angle to the incorporated surface which stiffen said incorporated surface against bending loads.

10. Mixer as defined in claim 7 wherein the separate flow channel is routed to the incorporated surface on a front side thereof.

* * * * *